US009414661B2

(12) United States Patent
Keong

(10) Patent No.: US 9,414,661 B2
(45) Date of Patent: Aug. 16, 2016

(54) HAIR BRUSHING APPLIANCE

(71) Applicant: Kenford Industrial Company Ltd, New Territories, Hong Kong (CN)

(72) Inventor: Wai Ho Michael Keong, Hong Kong (CN)

(73) Assignee: KENFORD INDUSTRIAL COMPANY LTD., New Territories, Hong Kong (CN)

( * ) Notice: Subject to any disclaimer, the term of this patent is extended or adjusted under 35 U.S.C. 154(b) by 0 days.

(21) Appl. No.: 14/378,668

(22) PCT Filed: Feb. 8, 2013

(86) PCT No.: PCT/CN2013/071555
§ 371 (c)(1),
(2) Date: Aug. 14, 2014

(87) PCT Pub. No.: WO2013/120445
PCT Pub. Date: Aug. 22, 2013

(65) Prior Publication Data

US 2015/0320169 A1 Nov. 12, 2015

(30) Foreign Application Priority Data

Feb. 16, 2012 (CN) ..... 2012 2 0049780 U

(51) Int. Cl.
*A45D 1/04* (2006.01)
*A46B 13/02* (2006.01)
(Continued)

(52) U.S. Cl.
CPC *A45D 1/04* (2013.01); *A45D 20/48* (2013.01); *A46B 9/023* (2013.01); *A46B 13/005* (2013.01); *A46B 13/02* (2013.01)

(58) Field of Classification Search
CPC ..... A45D 1/00; A45D 1/04; A45D 1/18; A45D 2/00; A45D 2/02; A45D 2/12; A45D 2/2464; A45D 2/2471; A45D 2/36; A45D 2/367; A45D 2/38; A45D 6/02; A45D 6/04; A45D 20/00; A45D 20/08; A45D 20/48; A45D 20/52; A46B 3/02; A46B 3/04; A46B 3/20; A46B 3/22; A46B 9/00; A46B 9/02; A46B 9/023; A46B 9/025; A46B 9/026; A46B 9/028; A46B 13/02; A46B 2200/10; A46B 2200/104; A46B 2200/1093
USPC ..... 132/238, 210, 211, 212, 119.1, 120, 132/121, 122, 226, 227, 229, 245, 269, 218, 132/216, 217, 141, 142
See application file for complete search history.

(56) References Cited

U.S. PATENT DOCUMENTS 3,431,571 A * 3/1969 Kraus ..... A46B 13/02 15/179

(Continued)

FOREIGN PATENT DOCUMENTS

CN 2891771 Y 4/2007
CN 202456955 U 10/2012

(Continued)

OTHER PUBLICATIONS

State Intellectual Property Office of the People's Republic of China; International Search Report in International Patent Application No. PCT/CN2013/071555, dated May 16, 2013.

*Primary Examiner* — Rachel Steitz
(74) *Attorney, Agent, or Firm* — Leydig, Voit & Mayer, Ltd.

(57) ABSTRACT

A rotary hair brushing and curling appliance includes a hollow rotary barrel of a thermally conductive material mounted to rotate on a handle, and having an external hair-engaging surface. Silicone rubber bristles are mounted on the barrel, and arranged in first and second sets projecting from first and second arcuate surfaces which are axially elongated and circumferentially spaced apart. Heating elements abut respective abutment surfaces inside the barrel. A reversible motor rotates the barrel. The first and second arcuate surfaces each occupy 10% to 40% of the external surface and are subtended at the axis by respective first and second central angles. The heating elements are positioned outside first and second sectors defined by the first and second central angles, focusing the conductive heat transfer to the adjacent relatively large unobstructed external areas of the barrel.

26 Claims, 4 Drawing Sheets

(51) Int. Cl.

| | |
|---|---|
| ***A45D 20/48*** | (2006.01) |
| ***A46B 9/02*** | (2006.01) |
| ***A46B 13/00*** | (2006.01) |

(56) References Cited

U.S. PATENT DOCUMENTS

| | | | | | |
|---|---|---|---|---|---|
| 3,750,680 | A * | 8/1973 | Miller | A45D 24/007 | 132/119.1 |
| 4,197,608 | A * | 4/1980 | Holley | A46B 7/10 | 132/118 |
| 4,217,915 | A | 8/1980 | Gress et al. | | |
| 4,257,434 | A * | 3/1981 | Wahl | A45D 1/04 | 132/118 |
| 4,314,137 | A * | 2/1982 | Dorn | A45D 1/04 | 132/118 |
| 4,329,567 | A * | 5/1982 | Kunz | A45D 1/18 | 132/118 |
| 4,469,934 | A * | 9/1984 | Isshiki | A45D 1/04 | 132/118 |
| 4,496,825 | A * | 1/1985 | Andis | A45D 1/18 | 132/118 |
| 4,564,032 | A * | 1/1986 | Araki | A45D 1/18 | 132/232 |
| 4,593,708 | A * | 6/1986 | Goeller | A45D 1/04 | 132/212 |
| 4,623,779 | A * | 11/1986 | Raab | A45D 1/18 | 132/229 |
| 5,337,765 | A * | 8/1994 | Wong | A45D 19/02 | 132/120 |
| 5,673,710 | A * | 10/1997 | Schaefer | A45D 1/18 | 132/118 |
| 7,045,744 | B2 | 5/2006 | Oh | | |
| 7,320,148 | B1 * | 1/2008 | Willette | A46B 9/023 | 132/119 |
| 7,930,793 | B2 * | 4/2011 | Stydahar | A46B 7/06 | 132/120 |
| 8,573,231 | B2 * | 11/2013 | Ragosta | A45D 20/50 | 132/119.1 |
| 8,602,038 | B2 * | 12/2013 | Choi | A45D 1/04 | 132/118 |
| 2003/0131865 | A1 * | 7/2003 | Richmond | A46B 9/021 | 132/119.1 |
| 2003/0192564 | A1 * | 10/2003 | Johnson | A45D 24/007 | 132/119.1 |
| 2004/0200495 | A1 * | 10/2004 | Lin | A46B 13/001 | 132/119.1 |
| 2014/0102471 | A1 * | 4/2014 | Kaizuka | A45D 1/04 | 132/223 |

FOREIGN PATENT DOCUMENTS

| | | | |
|---|---|---|---|
| GB | 2 106 384 | A | 4/1983 |
| JP | 2008-61829 | A | 3/2008 |

* cited by examiner

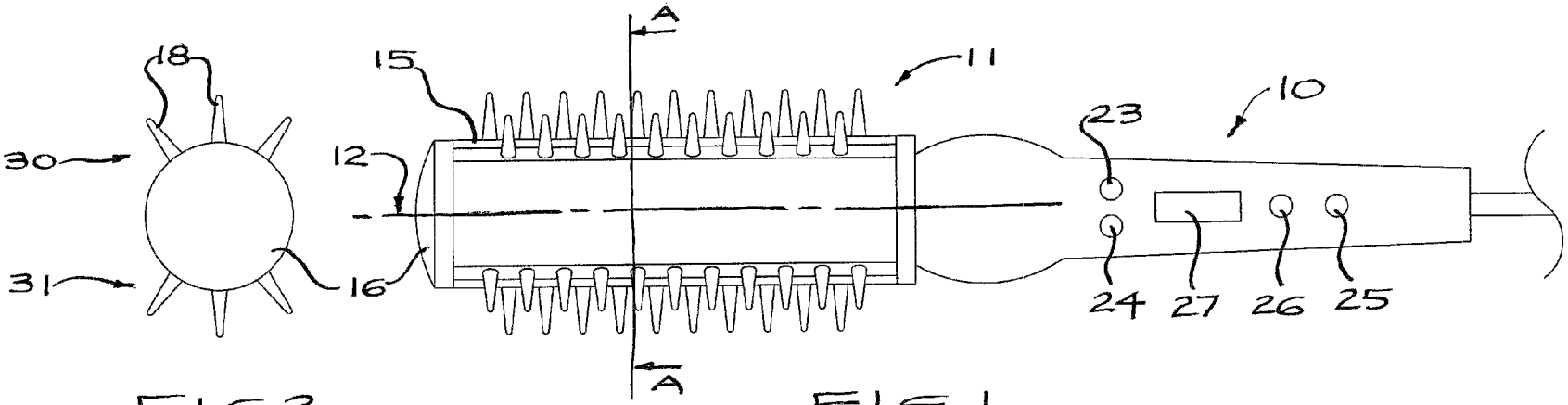
FIG. 1
FIG. 2
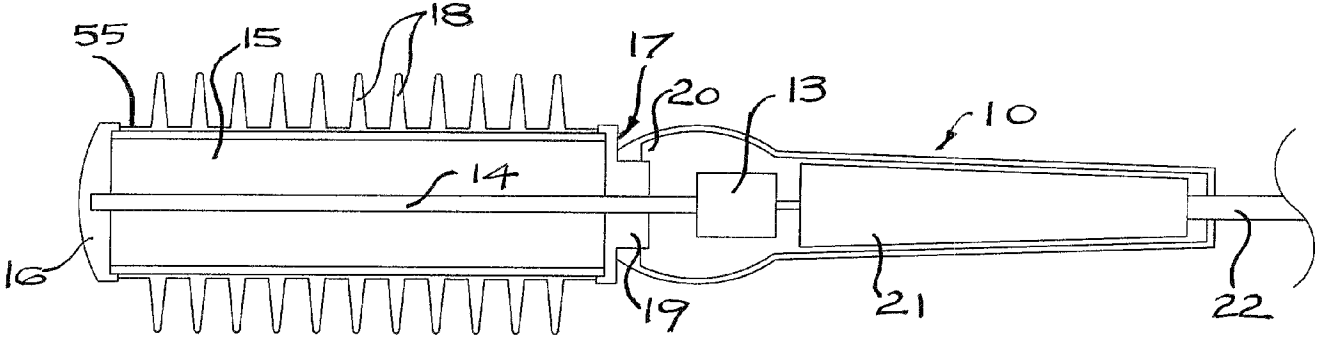
FIG. 3

HAIR BRUSHING APPLIANCE

The present invention relates to hair curling brushes. More particularly, although not exclusively, the invention relates to a hair curling brush having a motor-driven rotary brush heated by internal elements.

TECHNICAL FIELD

The present invention relates to hair curling brushes. More particularly, although not exclusively, the invention relates to a hair curling brushes having a motor-driven rotary brush heated by internal elements.

BACKGROUND OF THE INVENTION

Known motor-driven rotary brushes include a brush comprising a cylinder from which bristles project. A heating element in conductive contact with the inside of the cylinder is electrically coupled via slip rings to a power supply extending through a handle of the brush. For satisfactory performance of such brushes it has been considered necessary that heat should be evenly distributed throughout the cylinder, and to this end a high degree of symmetry is typically provided, with widely dispersed bristles and external hair-engaging surfaces. To distribute heat more evenly in the axial direction the elements are elongated axially, as are arrays of bristles and external hair-engaging surfaces. Even circumferential heat distribution is provided by a centrally positioned heating element, with regularly circumferentially spaced bristles interspersed with external hair-engaging surfaces. The heat distribution also influences fits and tolerances, and where the cylinder may be an assembly compromising inner and outer tubes the prior art teaches that these should of like material, thus assuring that free rotation of the cylinder assembly is not adversely affected by differential expansion during heating.

However, while the brushing performance of these appliances is generally satisfactory, there remains a need for providing improved heating, curling or styling.

It would be advantageous to provide a brush that provides sufficient grip for hair to be readily, evenly wound up onto the cylinder when engaged with the free end of a tress, while avoiding the typical situation where the hair is so firmly bound on the bristles that brush rotation to roll up the hair causes uneven pulling of the hair, or even jamming of the rotation. Furthermore, there is a need for more energy efficient appliances. It is an object of the present invention to address the above needs or, more generally, to provide an improved hair brushing appliance.

DISCLOSURE OF THE INVENTION

According to one aspect of the present invention there is provided a rotary hair brushing and curling appliance comprising:

a handle;

a hollow rotary barrel mounted to the handle to rotate about an axis, the barrel formed of thermally conductive material with an external surface;

at least two heating elements in the barrel, the heating elements substantially abutting respective abutment surfaces inside the barrel;

a reversible motor for rotating the barrel, and a plurality of bristles formed of silicon rubber and mounted to the barrel, the bristles being arranged in first and second sets projecting from first and second arcuate surfaces which are axially elongated and circumferentially spaced apart.

Preferably the first and second arcuate surfaces each comprising 10 to 40% of the external surface. Preferably the first and second arcuate surfaces are subtended at the axis by respective first and second central angles, and wherein the heating elements lie outside first and second sectors having the first and second central angles.

The relatively long circumferential portions between the first and second sets of bristles are heated by respective elements and, being uninterrupted, allow efficient heat transmission to the hair overlying them while, owing to their position separated from the elements the first and second sets of bristles are not excessively softened by the heat and provide sufficient grip to readily hold and wind up a tress for curling.

Preferably switching means are provided on the handle proximate the barrel for controlling the direction of motor rotation.

Preferably the abutment surfaces are diametrically opposing. Preferably the first and second arcuate surfaces are diametrically opposing.

Preferably the bristles in each set are arrayed in rows. Preferably the bristles in each row are regularly spaced from one another. Preferably each row of bristles is mounted in a groove in the external surface. Preferably the grooves are axial. Preferably each groove has an open mouth and a closed end, the width of the mouth being greater than or equal to the width of the closed end. Preferably combined area of the open mouths comprises 10-40% of the external surface area of the barrel. Preferably the bristles of each row are joined by a strip received in the groove. Preferably the bristles are of like frusto-conical form and tapered from a broad base to a narrow tip. Preferably axes of the bristles are aligned radially. Preferably the strip is wider than the base of the bristles. Preferably the strip is recessed below the external surface. Preferably the strip comprises silicon rubber. Preferably the bristles of adjacent rows are staggered to maximise the spacing between bristles of adjacent rows. Preferably the spacing between any two bristles in adjacent rows is more than the length of the bristles projecting from the external surface. Preferably the first and second sets each comprise respective first, second and third rows of bristles, the bristles of the first and third sets being aligned in a transverse plane.

Preferably 60-90 the external surface area of the barrel is exposed to the hair.

Preferably the heating elements are axially elongate and received in respective axial channels, wherein the abutment surfaces comprise surfaces of the channels. Preferably the channels comprise respective axial abutment faces which are concave. Preferably the axis defines a centre of curvature of the concave axial abutment faces.

Preferably the barrel is supported upon a shaft extending between axially opposing ends of the barrel, and a hollow member of thermal insulating material is spaced apart from the heating elements and substantially encloses the shaft. The thermally insulating material may comprise a polymer. Preferably the hollow member is tubular.

The rotary hair appliance of the invention can not only be used for hair brushing, but also for hair curling, where it offers improved performance. Avoiding the need to manually wind the hair about the hot cylinder, or apply a clip to hold the hair in contact with the barrel, the invention provides sufficient grip for hair to be readily, evenly wound up onto the cylinder just by simple engagement with the free end of a tress, while the relatively large, continuous hair-engaging area provides for efficient curling. However, the grip provided on the hair is not enough for the hair to become so firmly bound on the bristles that rotation of the brush to roll up the hair causes uneven pulling of the hair, or even jamming of the rotation.

BRIEF DESCRIPTION OF THE DRAWINGS

Preferred forms of the present invention will now be described by way of example with reference to the accompanying drawings, wherein:

FIG. 1 is a top view of a first embodiment of a rotary hair brushing and curling appliance according to the invention;

FIG. 2 is an end view of the appliance of FIG. 1;

FIG. 3 is a schematic longitudinal section through the appliance of FIG. 1;

DESCRIPTION OF THE PREFERRED EMBODIMENTS

Figure 6:
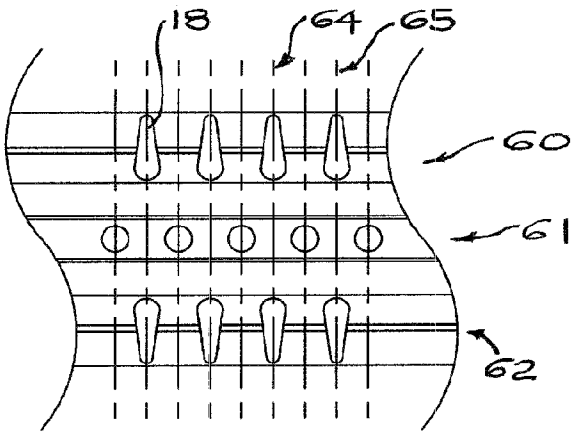
FIG. 6 is a fragmentary side view of the barrel of the appliance of FIG. 1.

Referring to FIGS. 1-4, a hand-held rotary hair brushing and curling appliance according to a first embodiment of the invention comprises a handle 10 to which a rotary brush 11 is mounted. The handle 10 and brush 11 may both be elongate and coaxial, with the brush 11 mounted to one end of the handle 10 to rotate about the axis 12. As used herein, the term "axial" refers to a direction substantially parallel to the axis 12. The term "radial" refers to a direction substantially orthogonal to the axis 12. The term "circumferential" refers to the direction of a circular arc having a radius substantially orthogonal to the axis 12.

The handle 10 is hollow and encloses a gearmotor 13 and a circuit board 21 to which power supply and control components (some of which are described below) may be mounted. Power may be supplied to the appliance by a cable 22 connected to a mains supply (not shown). Controls mounted to the handle 10 may include motor actuating switches 23, 24, as of the push-to-make type, respective ones of which may be pressed to rotate the brush in one direction or the other as desired. The motor actuating switches 23, 24 may conveniently be disposed at one end of the handle 13 proximate the brush 11. A power on/off switch 25 and a control switch 26 may be provided, along with a display 27. The control switch 26 may be used to control settings such as brush rotation speed and temperature, in cooperation with these settings being shown on the display 27.

The brush 11 is rotated as by a gearmotor 13 mounted in the handle 10 and connected by an axially extending shaft 14 to the brush 11. The brush 11 may generally comprise a barrel 15 of tubular form, to the axially opposing ends of which caps 16, 17 are fixed, and silicone rubber 18. The caps 16, 17 may close the distal and proximal ends of the barrel 15 respectively, and both may be fixed to turn with the shaft 14, the cap 17 may include a hub portion or coupler 19 supported within a mouth 20 of complementary form at one end of the handle 10, and serving to mechanically and electrically connect the brush to the handle 10.

Figure 4:
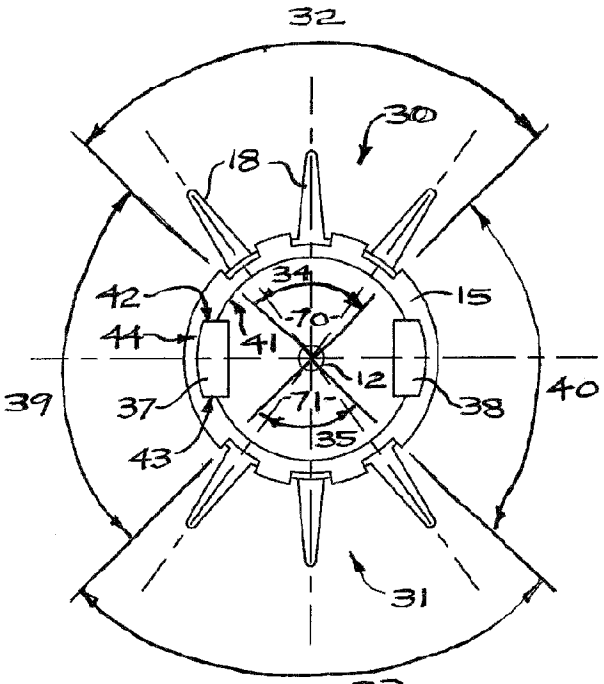
FIG. 4 is a schematic section along line AA of FIG. 1.

The 18 are arranged in first and second sets 30, 31 projecting from first and second arcuate surfaces 32, 33. The angular extent of each of the first and second arcuate surfaces 32, 33 is indicated in FIG. 4. The first and second arcuate surfaces 32, 33 may be of like angular extend and axial length, extending axially for the length of the barrel 15, and disposed diametrically opposite one another. The first and second arcuate surfaces 32, 33 are circumferentially spaced apart and, in a particularly preferred embodiment each may comprise approximately 18% of the external circumferential surface of the barrel 15. The first and second arcuate surfaces 32, 33 are subtended at the axis 12 by respective first and second central angles 34, 35. Sectors 70, 71 are defined by the first and second arcuate surfaces 32, 33 and the first and second central angles 34, 35 subtending them.

Two heating elements 37, 38 are fixed inside in the barrel 15 on the opposing side to external circumferential surface portions 39, 40 disposed between the first and second arcuate surfaces 32, 33. The heating elements 37, 38 may be axially elongate, extending generally either side of a transverse plane (not shown) bisecting the barrel 15. The heating elements 37, 38 lie outside first and second sectors 70, 71, adjacent the larger external circumferential surface portions 39, 40 which engage with the hair, thus preferentially heating these unobstructed portions.

The heating elements 37, 38 may be at least partially received in respective axial channels recessed from a cylindrical inner face 41 of the barrel 15, and having axially elongated opposing edges 42, 43 joined by a face 44. The axis 12 may define a centre of curvature of the face 44. The concave face 44 may form the major abutment face abutting the elements 37, 38 through which the majority of the heat from the element is conducted, with a relatively smaller portion being transferred through the surfaces of the edges 42, 43.

Figure 5:
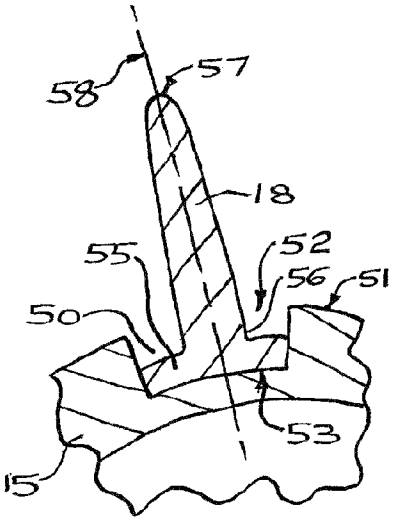
FIG. 5 is an enlarged view of a bristle of FIG. 4.

The bristles 18 of each set 30, 31 are arrayed in rows. Three rows may be provided in each set 30, 31 with the bristles 18 in each row being regularly spaced from one another. As best seen in FIG. 5, each row of bristles 18 may be mounted in a groove 50 in the external surface 51 of the barrel 15. The grooves 50 may extend axially for the length of the barrel 15, with each groove 50 having an open mouth 52 and a dosed end 53, the width of the mouth 52 being greater than or equal to the width of the dosed end 53, unlike some prior art designs where a narrow mouth serves to retain the bristles 18. In the embodiment illustrated, the edges of the grooves 50 along either side of the first and second arcuate surfaces 32, 33 define the boundaries of the heated, hair-engaging surface portions 39, 40. Conversely, the axial edges of the circumferential hair-engaging surface portions 39, 40 where they intersect the grooves 50 may be considered to define the boundaries of the first and second arcuate surfaces 32, 33. The bristles 18 may be of like frusto-conical form, tapered from a broad base 56 to a narrow, spheroidal tip 57. Axes 58 of the bristles may be aligned radially. The bristles 18 of each row may joined by an integral strip 55 received in the groove 50, and fastened to the barrel as by adhesive, welding, fasteners etc (not shown). The strip 55 may be wider than the base 56 of the bristles 18 and may be of complementary form and dimensions to the groove 50. The strip 55 and bristles 18 may be integrally formed from a silicon rubber elastomer with a hardness between 30 Shore A and 50 Shore D, making the bristles 18 flexible and resilient. The strip 55 may be recessed below the external surface 51, such that edges of the groove 50 do not interfere with flexure of the bristles 18. The barrel 15 is formed of a heat conducting material, such as a heat conducting polymer or, more preferably, aluminium.

Figure 8:
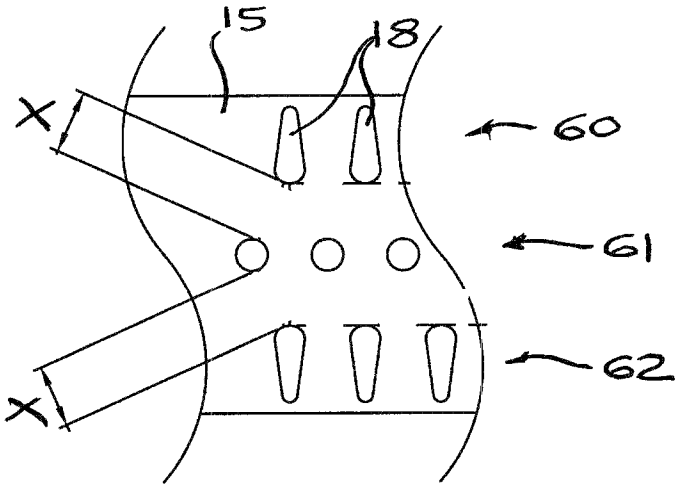
FIGS. 7 and 8 are fragmentary end and side views respectively of the barrel of the appliance of FIG. 1, and FIGS. 9 and 10 are transverse and longitudinal sections respectively of a second embodiment of a rotary hair brushing and curling appliance according to the invention.
Figure 7:
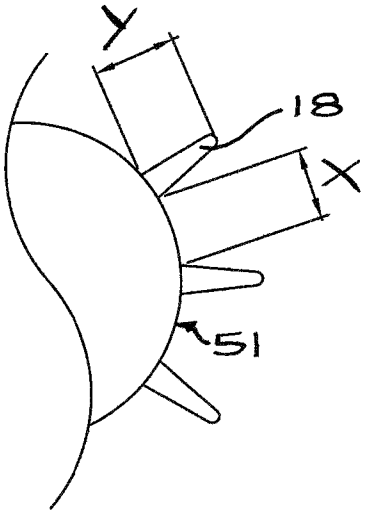

Referring to FIGS. 6 to 8, the bristles 18 are arranged in first, second and third axial rows 60, 61, 62 and adjacent rows are staggered to maximise the spacing between bristles 18 of adjacent rows. The bristles 18 of the first and third sets 60 and 62 may be aligned in the same transverse planes 64, 65 etc. The spacing X between any two bristles 18 in adjacent rows 60/61 or 61/62 is more than the length Y of the bristles 18 projecting from the external surface 51, such that when deflected in bending the bristles 18 cannot contact one another.

Figure 10:
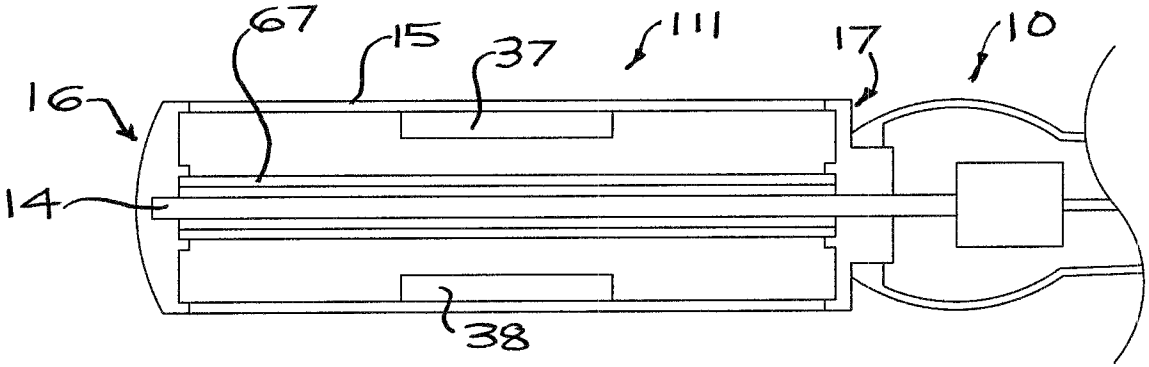
Figure 9:
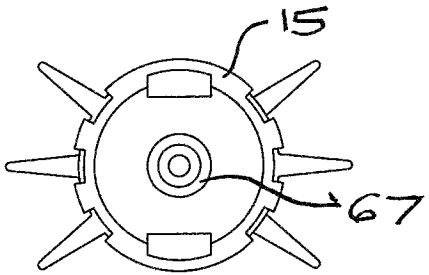

FIGS. 9 and 10 illustrate a second embodiment of the invention comprising a brush 111 mounted to the handle 10, in which brush 111 is of like construction to the brush 11 but further comprises a hollow member 67 extending axially between the end caps 16, 17 and enclosing the shaft 14. The hollow member 67 is made of thermal insulating material, such as a polymer, and is spaced apart from the heating elements 37, 38. The hollow member may be tubular, with the inside of the hollow member 67 communicating with the inside of the hollow handle 10. The hollow member 67 thus thermally insulates the shaft 14 from heat produced by the elements.

In use, the appliance may be used for brushing and simultaneously drying hair by actuating one of the switches 23, 24 to rotate the brush 11, 111, starting at the scalp end of a tress and moving toward the free end along the tress generally tangential to the outer surface 51 and moving in the same sense as the brush is rotated. Styling and curling may be achieved in a number of ways, but advantageously curling is started by engaging the brush with the free end of the tress. While the density of bristles 18 provided in the first and second arcuate surfaces 32, 33 (i.e. the number of bristles per square millimeter) is within the range provided on some prior art rotary brushes, the friction between the brush 11, 111 and the hair has been found to be sufficient to grasp and hold the hair. With the brush preferably stationary initially while one of the sets 30, 31 is engaged with the hair, one of the switches 23, 24 is actuated to rotate the brush 11, 111, whereupon the tips are wound about the barrel 15, the appliance then being moved tangentially in the opposite sense to the brush rotation as the tress continues to be wound toward the scalp end. The relatively long uninterrupted circumferential portions 39, 40 provide for efficient heat transmission to the hair. Once a wave has been set the tress can be unwound without the need to rotate the brush 11, 111. During the course of curling treatment a certain degree of slip may occur between the hair and the brush, thus increasing the length of hair exposed, for instance, to the convex hair-engaging surfaces 39, 40 and thus increasing the "effective exposed area" beyond the 60-90% of the external surface area of the barrel is exposed to the hair.

Aspects of the present invention have been described by way of example only and it should be appreciated that modifications and additions may be made thereto without departing from the scope thereof.

The invention claimed is:

1. A rotary hair brushing and curling appliance comprising:
- a handle;
- a hollow rotary barrel mounted on the handle for rotating about an axis, wherein the barrel is a thermally conductive material with an external surface;
- at least two heating elements in the barrel, wherein the heating elements substantially abut respective abutment surfaces inside the barrel;
- a reversible motor coupled to the barrel for rotating the barrel; and
- a plurality of bristles of silicone rubber mounted on the barrel, wherein
  - the bristles are arranged in first and second sets projecting from first and second arcuate surfaces of the barrel,
  - the first and second arcuate surfaces are axially elongated and circumferentially spaced apart, and
  - each of the first and second arcuate surfaces comprises 10% to 40% of the external surface.

2. The appliance of claim 1, wherein the first and second arcuate surfaces are subtended at the axis by respective first and second central angles, and
- the heating elements lie outside first and second sectors defined by the first and second central angles.

3. The appliance of claim 2 including a switch located on the handle proximate the barrel for controlling direction of motor rotation.

4. The appliance of claim 2 wherein the abutment surfaces are diametrically opposed to each other.

5. The appliance of claim 2 wherein the first and second arcuate surfaces are diametrically opposed to each other.

6. The appliance of claim 2 wherein the bristles in each of the first and second sets are arrayed in rows.

7. The appliance of claim 6 wherein the bristles in each row are regularly spaced apart.

8. The appliance of claim 7 wherein
- the external surface includes a plurality of grooves, and
- each row of bristles is mounted in a respective groove in the external surface.

9. The appliance of claim 8 wherein the grooves are axial.

10. The appliance of claim 1 including
- a shaft extending between axially opposing ends of the barrel and supporting the barrel, and
- a hollow member of a thermal insulating material spaced apart from the heating elements and substantially enclosing the shaft.

11. The appliance of claim 10 wherein the hollow member is tubular.

12. A rotary hair brushing and curling appliance comprising:
- a handle;
- a hollow rotary barrel mounted on the handle for rotating about an axis, wherein the barrel is a thermally conductive material with an external surface;
- at least two heating elements in the barrel, wherein the heating elements substantially abut respective abutment surfaces that are diametrically opposed to each other, inside the barrel;
- a reversible motor coupled to the barrel for rotating the barrel;
- a switch located on the handle proximate the barrel for controlling direction of motor rotation; and
- a plurality of bristles of silicone rubber and mounted on the barrel, wherein
  - the bristles are arranged in first and second sets projecting from first and second arcuate surfaces on the barrel,
  - the first and second arcuate surfaces are axially elongated, circumferentially spaced apart, and diametrically opposed to each other,
  - each of the first and second arcuate surfaces comprises 10% to 40% of the external surface and is subtended at the axis by respective first and second central angles,
  - the heating elements lie outside first and second sectors defined by the first and second central angles,
  - the bristles, in each of the first and second sets, are arrayed in rows,
  - the bristles in each row are regularly spaced apart, and
  - each row of bristles is mounted in a respective axial groove in the external surface.

13. The appliance of claim 12 wherein
- each groove in the external surface has an open mouth and a closed end, and
- combined area of the open mouths comprises 10% to 40% of the external surface area of the barrel.

14. The appliance of claim 12 wherein the bristles in each row are joined by a strip received in the groove.

15. The appliance of claim 14 wherein the bristles have a frusto-conical form and taper from a broad base to a narrow tip.

16. The appliance of claim 15 wherein the strip is wider than the base of the bristles.

17. The appliance of claim 14 wherein the strip is recessed with respect to the external surface.

18. The appliance of claim 14 wherein the strip comprises silicone rubber.

19. The appliance of claim 12 wherein axes of the bristles are aligned radially.

20. The appliance of claim 12 wherein the bristles of adjacent rows are staggered to maximise spacing between bristles of adjacent rows.

21. The appliance of claim 20 wherein the spacing between any two bristles in adjacent rows is more than length of the bristles projecting from the external surface.

22. The appliance of claim 20 wherein each of the first and second sets of bristles comprises respective first, second, and third rows of bristles, and the bristles of the first and third rows are aligned in a transverse plane.

23. The appliance of claim 1 wherein 60% to 90% of the external surface of the barrel is exposed to hair.

24. The appliance of claim 1 wherein the heating elements are axially elongate and received in respective axial channels, and the abutment surfaces comprise surfaces of the channels.

25. The appliance of claim 24 wherein the channels comprise respective axial abutment faces which are concave.

26. The appliance of claim 25 wherein the axis defines a centre of curvature of the concave axial abutment faces.

* * * * *